US005301525A

United States Patent [19]

Döring

[11] Patent Number: 5,301,525

[45] Date of Patent: Apr. 12, 1994

[54] LOCK, PARTICULARLY MORTISE LOCK

[75] Inventor: Rolf Döring, Heiligenhaus, Fed. Rep. of Germany

[73] Assignee: Carl Fuhr GmbH & Co., Heiligenhaus, Fed. Rep. of Germany

[21] Appl. No.: 869,781

[22] Filed: Apr. 16, 1992

[30] Foreign Application Priority Data

Jun. 5, 1991 [DE] Fed. Rep. of Germany ..... 4118480

[51] Int. Cl.[5] ..... E05B 59/04

[52] U.S. Cl. ..... 70/107; 292/34; 70/110

[58] Field of Search ..... 70/107, 110, 111; 292/34, 165

[56] References Cited

U.S. PATENT DOCUMENTS

| | | | |
|---|---|---|---|
| 971,314 | 9/1910 | Schacht | 70/107 |
| 1,706,486 | 3/1929 | Gasey | 292/165 |
| 1,855,608 | 4/1932 | Lyons et al. | 70/107 |
| 2,086,982 | 7/1937 | McCarter | 292/165 |
| 3,242,706 | 3/1966 | Check | 70/110 |
| 3,464,242 | 9/1969 | Torii . | |
| 3,672,714 | 6/1972 | Schultz | 70/107 |
| 3,783,658 | 1/1974 | Wada | 70/110 |
| 3,999,411 | 12/1976 | Kambic | 292/34 |
| 4,683,733 | 8/1987 | Marin . | |
| 4,870,841 | 10/1989 | Cudd | 70/107 |

FOREIGN PATENT DOCUMENTS

| | | | |
|---|---|---|---|
| 0352495 | 1/1990 | European Pat. Off. . | |
| 3826802 | 2/1990 | Fed. Rep. of Germany | 70/107 |
| 215501 | 12/1923 | United Kingdom . | |
| 1485267 | 9/1977 | United Kingdom . | |
| 8902020 | 3/1989 | World Int. Prop. O. | 70/107 |

*Primary Examiner*—Peter M. Cuomo
*Assistant Examiner*—Darnell M. Boucher
*Attorney, Agent, or Firm*—Martin A. Farber

[57] ABSTRACT

A lock, particularly a mortise lock, with bolt (9) and preferably catch (43) and a step-up lever (27) which acts on the bolt (9) and is equipped with a closure engagement opening (30) and is pivoted below the axis of rotation of the closure bit, for the closing of the bolt (9) in forward and backward direction while obtaining a lengthening of the closing stroke; in order to optimize the design, it is proposed that the path of movement of the closing engagement opening (30) extend approximately over a quarter-circle (V) of the cylindrical head (7) of a profiled-cylinder insertion opening (4).

12 Claims, 8 Drawing Sheets 52
84
85
43''
35
43
43'
38
58''
56
58
57
63
58'
3
1
9
24
7
4
8
8'
28
5
53

73
43
43'
1
10
9
5

1
52
2
99
96
101
97
98
95
92
93
90
91
89
74
43''
82
78
100
84
40
82
48
43'
50
37
35
88
43
M1
73
72
42
45
47
14'
M2
49
44
38
39
51
46
36
41
86
56
14
54
97
59
102
57
87
55
63
53
98

FIG. 7
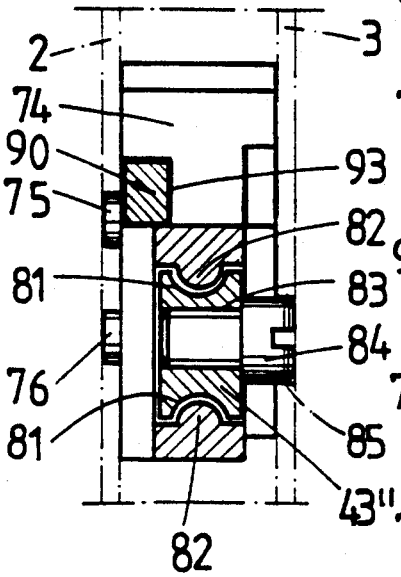
FIG. 6
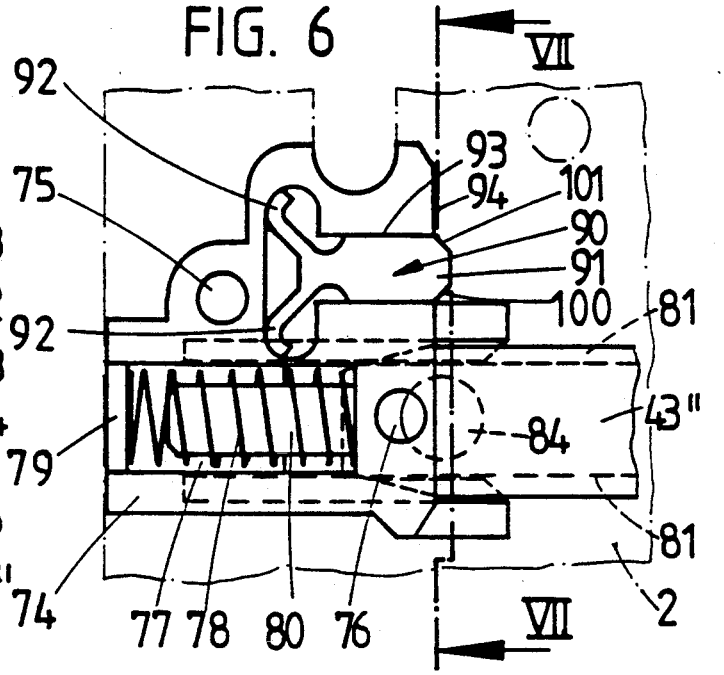
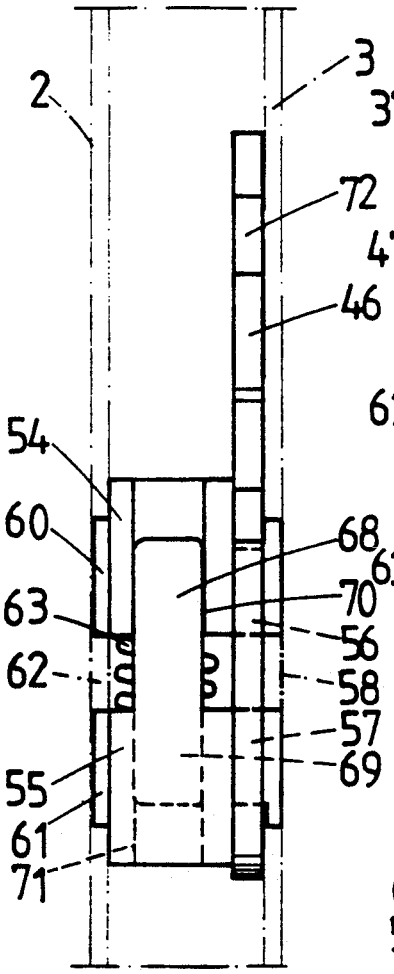
FIG. 8
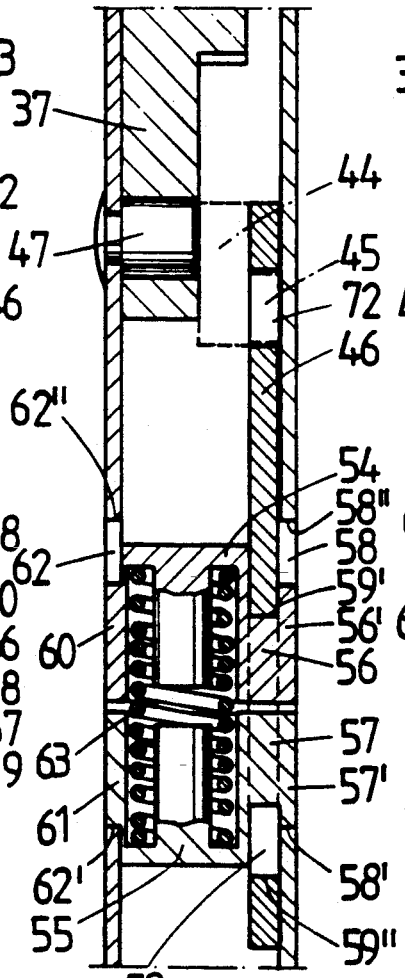
FIG. 10
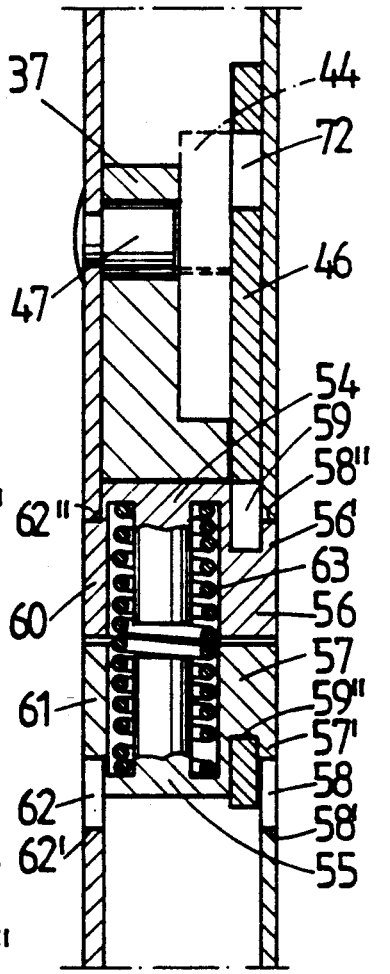
FIG. 12

52
1
2
99
96
97
89
98
90
74
84
43'
88
50
43
43''
40
42
37
48
M1
73
35
M2
49
47
38
72
14'
45
36
B
86
41
51
44
46
97
54
56
102
87
57
14
55
98
59
53

1
52
2
98
89
100
101
90
73
84
91
99
96
78
74
50
35
45
C
72
44
M2
47
37
41
51
59
54
46
56
55
57
43"
97
95
40
88
43
43'
42
86
36
14'
49
48
98
14
53
97
87
M1

LOCK, PARTICULARLY MORTISE LOCK

FIELD AND BACKGROUND OF THE INVENTION

The present invention relates to a lock, particularly a mortise lock, with bolt and preferably catch and a step-up lever which is provided with a closure-engagement opening and acts on the bolt for the moving forward and back of the bolt while obtaining a lengthening of the closing stroke, and furthermore with another lever which can be lifted away by a closure bit against spring action.

A lock of the type in question is known from Federal Republic of Germany Utility Model 16 41 147, in which the single-arm step-up lever which is mounted below the closure-bit insertion opening is in pin/slot engagement with the bolt at its free end. In the region of the closure-bit insertion opening, the step-up lever forms an opening which is provided with a closure engagement opening which is directed radially to the bolt. A turn pin extends adjacent to the closure-engagement opening. This pin cooperates with the turn recesses of tumblers mounted on the lock-housing side. Such a lock is not suitable for closure cylinders developed as profiled cylinders. Furthermore, push-back forces exerted on the bolt upon an attempt at breaking in act on the step-up lever, doing so also in stepped-up manner, together with poor security against breaking-in.

From Federal Republic of Germany OS 26 42 367, there is also known a lock the step-up lever of which is also in pin/slot engagement with the bolt. The step-up lever itself does not form a closure engagement opening, but it is acted on on its corresponding rear edge only upon the advancing of the bolt. Upon backward movement by means of the closure member of the profiled cylinder, the cylinder acts on an angle arm of a slide guided in the bolt. This development requires a large number of parts and leads to an increased expense in manufacture.

SUMMARY OF THE INVENTION

The object of the present invention is so to develop a lock of this type of simple construction that profiled cylinders can be used while obtaining an optimal manner of closing and increased security against burglary.

This object is achieved in a lock of this type by the fact that the path of movement of the closure engagement opening (30) extends over a quarter-circle (V) of the cylindrical head section (7) of a profiled-cylinder insertion opening (4).

As a result of this development, for the first time a lock of the type in question is provided which cooperates with a profiled cylinder and permits lever-enlarged opening and closing of the bolt in the manner that the closure member acts exclusively on the step-up lever. The path of movement of the closure engagement opening present on the step-up lever extends in this connection approximately over one-quarter of the cylindrical head section of the profiled-cylinder insertion opening. This quarter-circle is located on the side facing the rear wall of the lock. This means that, with step-up lever pivoted below the axis of rotation of the closure bit, the lever grips around approximately two-thirds of the circumference of the profiled cylinder and nevertheless assures the step-up lever a large angle of swing, together with a large advance of the bolt with only one closure turn. The result is nevertheless obtained that in each end position of the step-up lever the closure member engages the closure engagement opening of the step-up lever and carries it along in the corresponding direction. In this connection the end points of the quarter-circle section alternately coincide approximately with the positions which the end mouth points of the edge mounting of the closure-cylinder engagement opening assume in the two closed positions. The edge mounting in this connection leads to an application of larger area of the closure member against the step-up lever so that, on the one hand, optimal forces can be transmitted upon the closing and, on the other hand, premature wear is counteracted. There is then present such an arrangement of the closure engagement opening that the mouth thereof does not extend beyond the line connecting the pivot point of the step-up lever and slot/pin engagement place on the bolt. Upon each closing process, therefore, the pin moves in only one direction in the slot. In the state of the art shown in Federal Republic of Germany Utility Model 16 41 147, a forward and backward movement of the pin within the slot takes place upon each closing turn. A three-position characteristic results from the fact that the other lever is mounted on the bolt and the edge mounting of the closure engagement opening of the step-up lever lies within the region of a rear cutout on the tail of the bolt, which cutout is covered by a partial region of the other lever. The lever spring can therefore also act between bolt and lever. Bolt and lever, including the spring, can be inserted as a preassembled unit upon the final assembly after the installation of the step-up lever. The first position of the said three-position character is represented by the step-up lever. The next is the bolt into the cutout on the rear of which the edge mounting extends. The third position then is represented by the lever which rests alongside the bolt also on the edge mounting of the step-up lever, the corresponding region of the lever extending into the closure engagement opening. The fact that the pivot point of the step-up lever lies at the height of the lower rounding flanged section of the profiled cylinder insertion opening contributes to the wide gripping of the profiled cylinder. It should furthermore be pointed out that the lever spring lies in a recess in the bolt tail and is covered at least in part by the lever. In this way, the lever spring is also imparted stability of position. The lever, on its part, cooperates with two abutments formed, fixed in position, on the cover of the lock. The abutments are developed displaced from each other in the closing direction. The abutments are also so displaced from each other in upward direction that the abutment adjacent the lock front is higher. This is also the abutment against which the lever rests when the bolt is advanced so that corresponding backward-pressing forces are favorably taken up and are not conducted into the step-up lever as in the prior art. In order for a disturbance-free closing of the bolt to be possible despite the two abutments, the lever forms a channel for the movement of the abutments. Abutments of large size are possible due to the fact that the bottom of the channel lies at the same height as the corresponding side wall of the bolt, so that a large depth of entrance is present on the lever. If the bottom of the channel continues into the mounting plate, the lever, together with its mounting plate, can pass in the advanced position into the region of the lock front.

BRIEF DESCRIPTION OF THE DRAWINGS

One embodiment of the invention will be described below with reference to the drawing, in which:

FIG. 6 is a view of the shoe which receives the tail of the catch as well as the catch spring, seen from the bottom of the lock;

FIG. 7 is a section along the line VII—VII of FIG. 6;

FIG. 8 is a view of the coupling member present between lock cover and lock bottom with carriage spread apart under spring action, shown in its starting position;

FIG. 10 is a view corresponding to FIG. 4 showing the condition of the coupling member with carriage in FIG. 9;

FIG. 12 is a sectional view corresponding to FIG. 4 in the position shown in FIG. 11;

DETAILED DESCRIPTION OF THE PREFERRED EMBODIMENT

Figure 1:
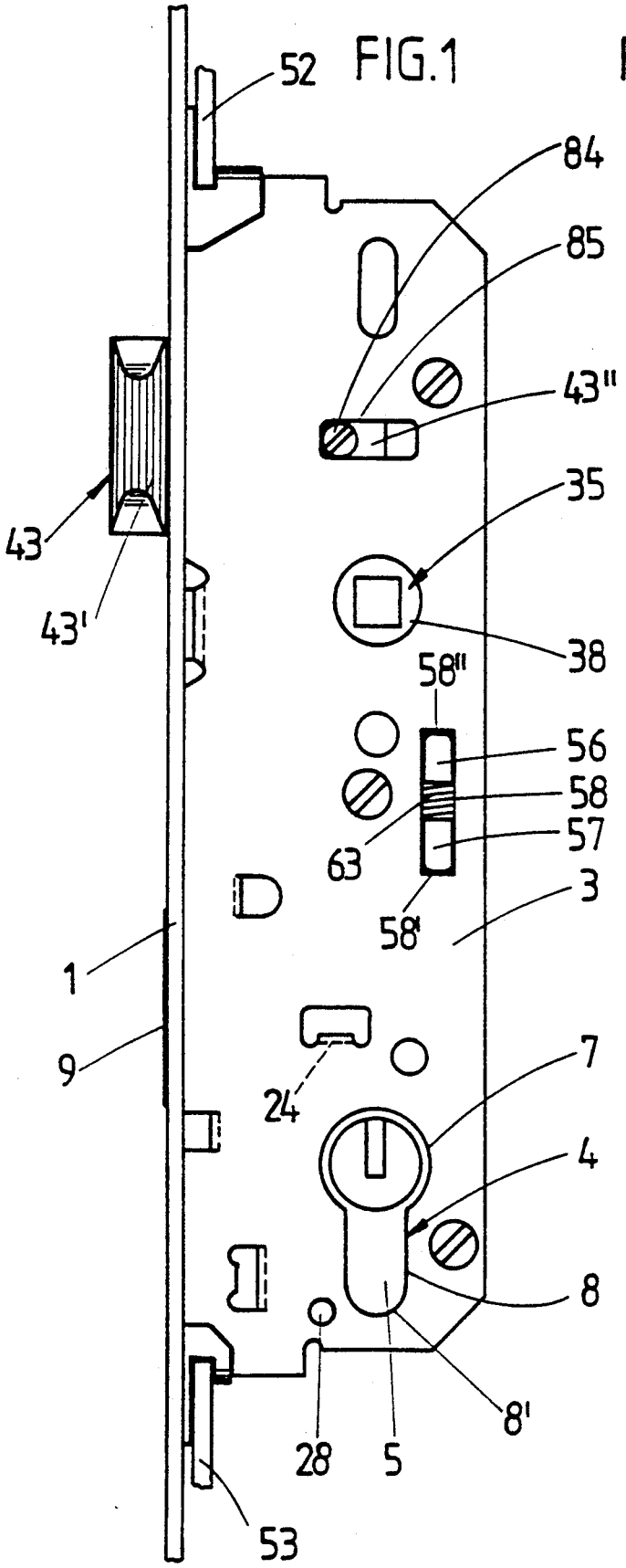
FIG. 1 is a view in elevation of a lock developed as drive-bar lock with drive bar in open position and the catch advanced.
Figure 2:
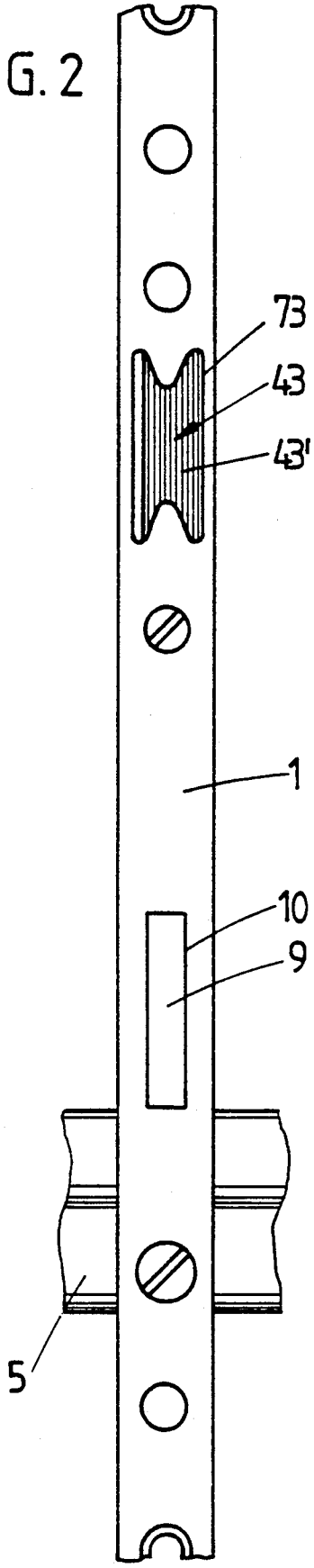
FIG. 2 is a side view of FIG. 1.

The lock, which is developed as a drive-bar lock, has a lock front 1 with a lock wall representing the lock bottom 2 which is connected to it. The lock wall forming the lock cover 3 is held in parallel arrangement to it. The lock ward extends between lock bottom 2 and lock cover 3.

In the lower region of the lock housing, a profiled-cylinder insertion opening 4 for the reception of a profiled cylinder 5 is provided in the lock bottom 2 and lock cover 3. A closure-member hub 6 with a closure member 6' extending radially from it, shown in dash line in FIGS. 13, 16, can be guided by it.

The cross-sectional shape of the profiled cylinder 5 corresponds to that of the profiled-cylinder insertion opening 4. The latter is formed of a cylindrical head section 7 and a flanged section 8 which extends radially thereto and passes, near the lower edge of the lock housing, into a rounding flanged section 8'.

A bolt 9 is guided closely above the profiled-cylinder insertion opening 4. It is formed of a bolt head 9' and an adjacent bolt tail 9''. For the guiding of the bolt 9, there is provided, on the one hand, an opening 10 in the lock front 1, the cross section of which opening is adapted to the bolt head 9'. On the other hand, a transversely directed projection 11 extends from the bolt tail 9'' in the upper region, it engaging in a slot 12 extending perpendicular to the lock front 1 in the lock bottom 2. The projection 11 is set back with respect to a stop projection 13 which serves for the blocking of a drive-bar connection slide 14 in the locked position thereof. The stop projection 13 bridges in this connection over the distance between the bolt tail 9'' and the lock bottom 2; see, in particular, FIG. 15.

The bolt tail 9'' is provided on its side facing the bolt cover 3 with a stepped-down recess 15 forming a thinner end section of the bolt tail 9''. In this region, there is a slot 16 which extends transverse to the closing direction of the bolt 9 and is intended to receive a lever spring 17, developed as a compression spring. The upper end of said spring rests against the corresponding transverse edge of the slot 16. The lower end of the lever spring 17 rests against a tongue 18 of a lever 19, the tongue extending into the slot 16. The lever is mounted swingably on the bolt tail 9'' with the mounting place facing the bolt head 9'. This place is formed by a mounting pin 21 which extends from a mounting plate 20 of the lever 19, the pin extending into a mounting hole 22 of the bolt tail 9'', which hole is of corresponding cross section. The lever spring 17, as can be noted from the figures, is at least partially covered by the lever 19. The lever 19 receives its stop limitation in the manner that the spring-loaded tongue 18 rests against the lower obliquely extending end of the slot 16; see FIG. 13.

Figure 14:
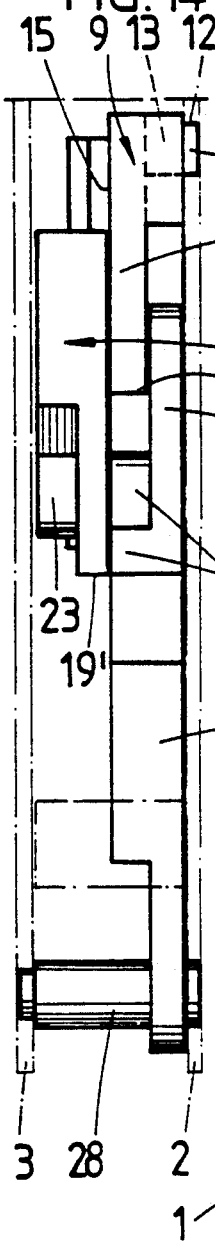
FIG. 14 is a side view of FIG. 13.
Figure 15:
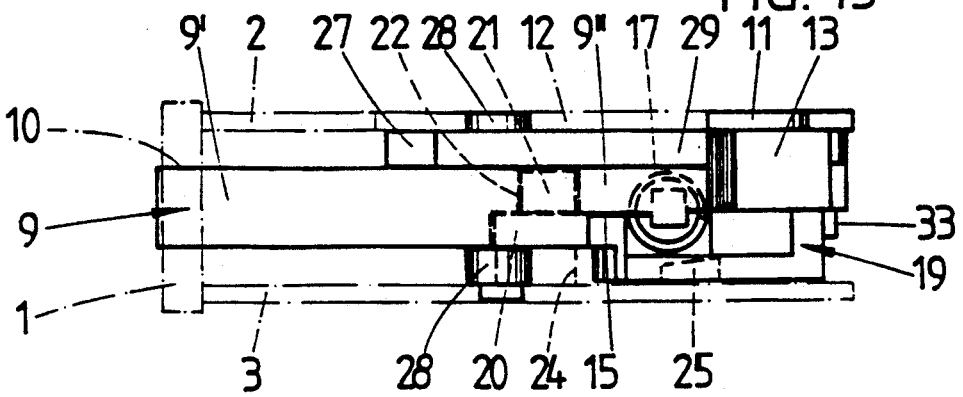
FIG. 15 is a top view of FIG. 13, but with the lock walls—lock bottom and lock cover—omitted.

In its region lying on the other side of the mounting plate 20, the lever 19 is so thick that it extends up to the lock cover 3; see FIGS. 14 and 15. In this region, the lever 19 has a channel 23 which ascends obliquely in the direction towards the mounting place, the bottom of which channel continues in the mounting plate 20. By reason hereof, with the bolt 9 advanced, the mounting plate 20 can come into position overlapping the lock front 1; see FIG. 16.

The lever 19 cooperates with two abutments 24 and 25 fixed in position on the lock cover 3. These abutments are spaced from each other in the closing direction of the bolt. Furthermore, the abutments 24, 25 are so shifted in vertical direction from each other that the abutment 25 adjacent the lock front 1 lies higher, but extends at the height of the channel 23. The upper side wall of the channel 23 has a stepped-down alignment, with the formation of a blocking extension 26 in front of which the bolt 24 extends in the rearward closed position of the bolt 9; see FIG. 13. The bolt 9 is thus blocked against moving forward.

The driving of the bolt 9 is effected, upon the closing rotation of the closure member 6', via a step-up lever 27. The latter is a single-arm lever, the pivot point 28 of which lies at the height of the lower rounding flanged section 8' of the profiled-cylinder insertion opening 8, on the side facing the lock front 1. Above the head section 7, the step-up lever 27 is continued by a bend 29 which extends up to the rear of the lock and has a closure engagement opening 30 for the entrance of the closure member 6'. The bend 29, which extends between bolt tail 9" and lock bottom 2, bears a pin 31 pointing in the direction of the bolt 9, the pin engaging in a slot 32 extending transverse to the direction of closing in the bolt tail 9". With the bolt 9 pulled back, the pin 31 extends on the lower end of the slot 32; see FIG. 13. Furthermore, the bend 29 forms, within the region of the closure engagement opening 30, an edge mounting 33 for which a cutout 34 is provided in the stepped end section of the bolt tail 9". Step-up lever 27, bolt tail 9" and lever 19 therefore form a three-layer arrangement which extends into the space between lock front 3 and lock bottom 2. Furthermore, the lower edge 19' of the lever 19 which extends obliquely in the direction towards the lock cover 1 extends into the closure-engagement opening 30.

Figure 13:
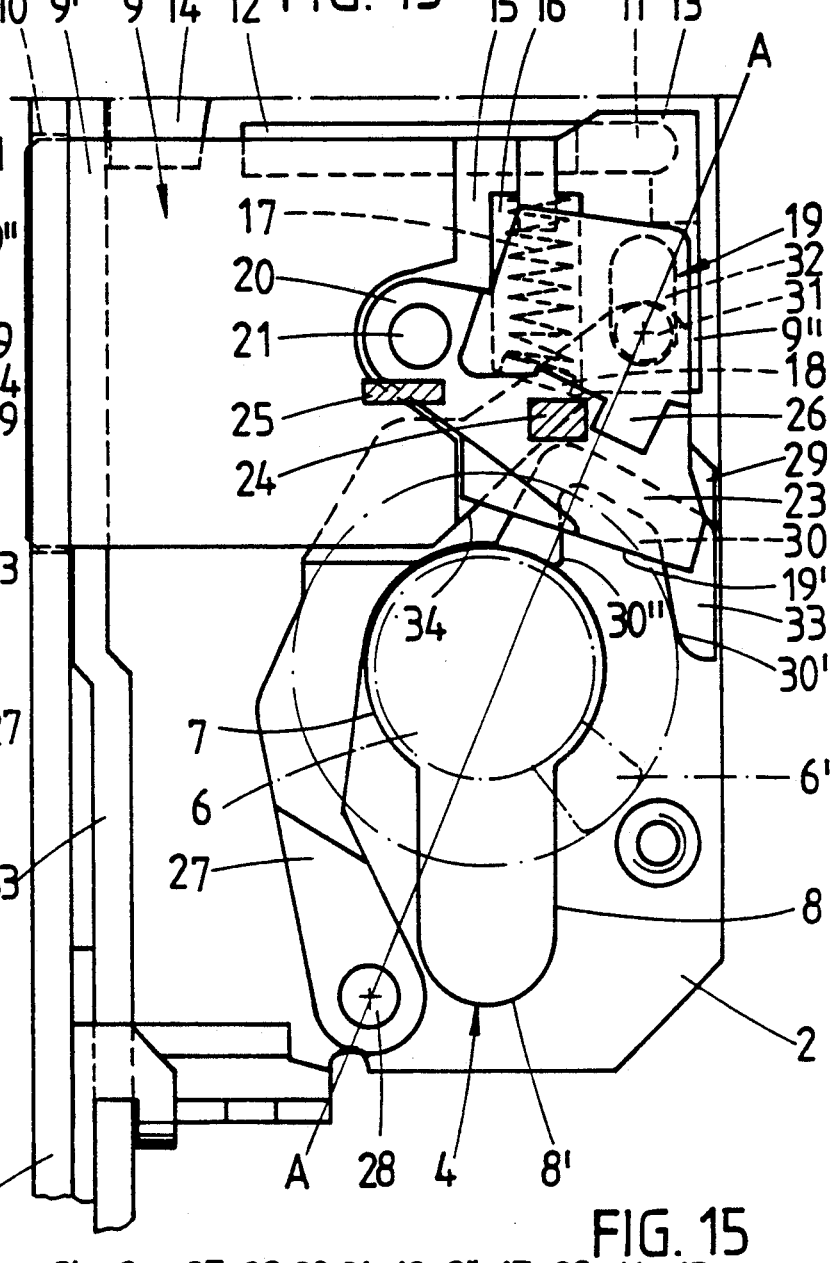
FIG. 13 is an enlarged view of the lower region of the drive-bar lock in the region of the bolt with the bolt pushed back.
Figure 16:
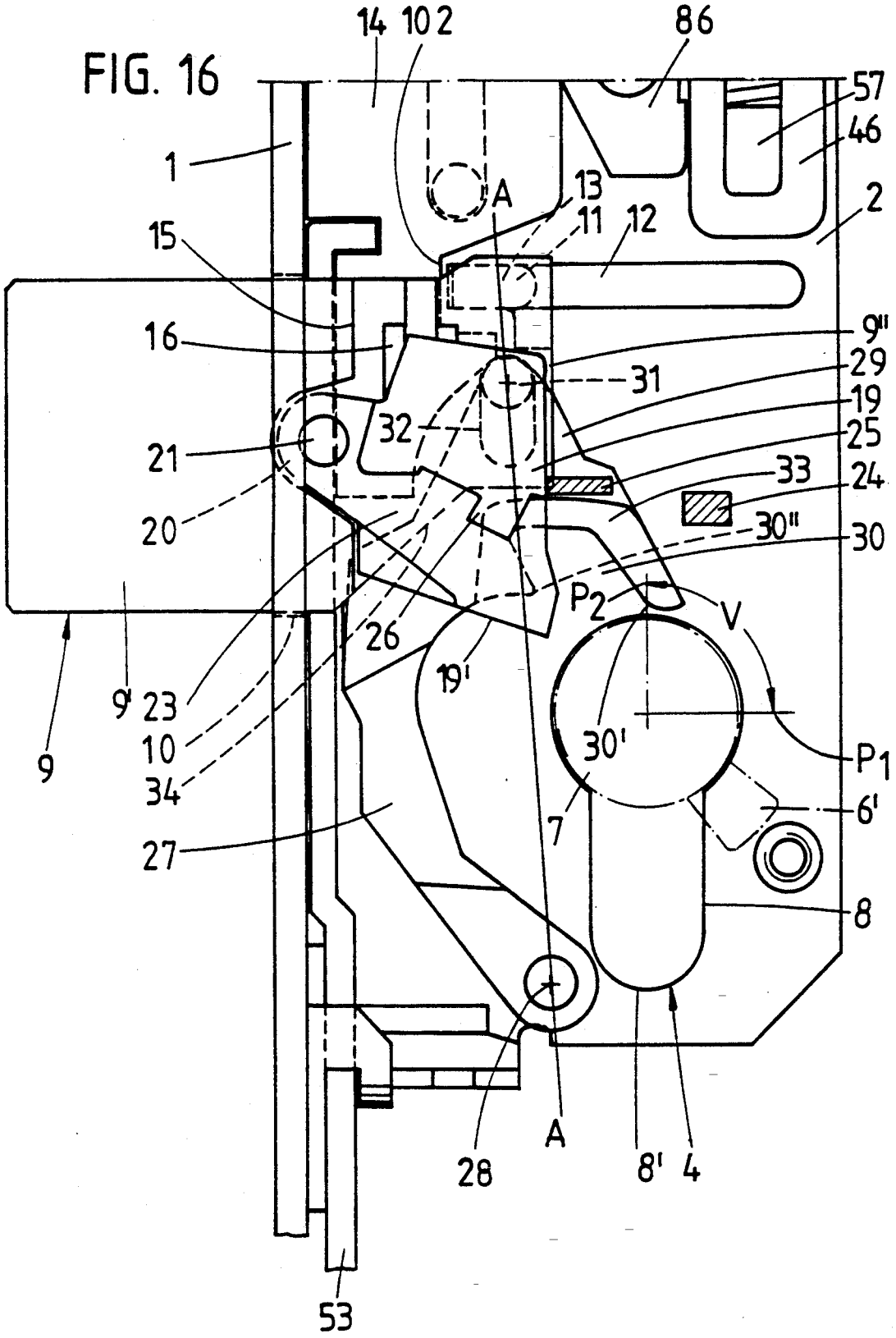
FIG. 16 is a view corresponding to FIG. 13 but with the bolt advanced.

As can be noted from FIGS. 13 and 16, the closure engagement opening 30 does not go beyond the connecting line A—A of the pivot point 28 of the step-up lever 27 and slot/pin engagement place 31/32 on the bolt 9 neither when the bolt is retracted nor when it is advanced.

In the upper region of the lock housing, a bipartite hub 35 is mounted. It is formed of two hub parts 36 and 37. The hub part 36 has a central hub 38 which serves for mounting in the lock bottom 2 and lock cover 3. The corresponding mounting place is located vertically above the profiled-cylinder insertion opening 4 at a standardized distance away. The hub 38 is developed as a semi-circular disc 39, the radial shoulders of which form stop surfaces 40, 41. In front of one radial stop shoulder—stop surface 40—there is arranged a driver arm 42 for pulling back a catch 43 which is arranged above the hub 35. In the same plane as the disc 39 there extends an actuating arm 44 which extends from the hub 38 and passes perpendicularly to the stop surfaces 40, 41, the arm being in form-locked connection, via a projection 41 developed thereon, with a coupling member 46. The two hub parts 36, 37 however have different axes of rotation M1 and M2. The axis of rotation M2 of the hub part 37 which cooperates with the drive-bar connecting slide 14 is shifted, with respect to the axis of rotation M1 of the hub part 36, towards the lock rear wall. In this way, a favorable lever ratio can be obtained. The axis of rotation Ml is formed by the hub 38, while the axis of rotation M2 is formed by a standing pin 47 on the bottom side of the lock. Within the hub part 37 there is a slot 48 which receives the hub 38 for movement around the hub 38. At its free end there is developed on the hub part 37 a driver projection 49 which extends into a transverse slot 14' in the drive-bar connecting slide 14. A swinging of the hub part 37 therefore leads to a positive entrainment of the drive-bar connection slide 14. Furthermore, the hub part 37 is provided on its wide side facing the disc 39 with projections forming stop surfaces 50, 51. They lie in the field of action of the stop surfaces 40, 41 of the hub part 36. In the open position of the drive-bar lock, with the drive-bar connecting slide 14, from the end of which the drive bars 52 and 53 extend, assuming the release position, the hub parts 36, 37 assume such a position to each other that the stop surfaces 41, 51 lie closely apart while the other stop surfaces 40, 50 leave a free passage between them.

Figure 4:
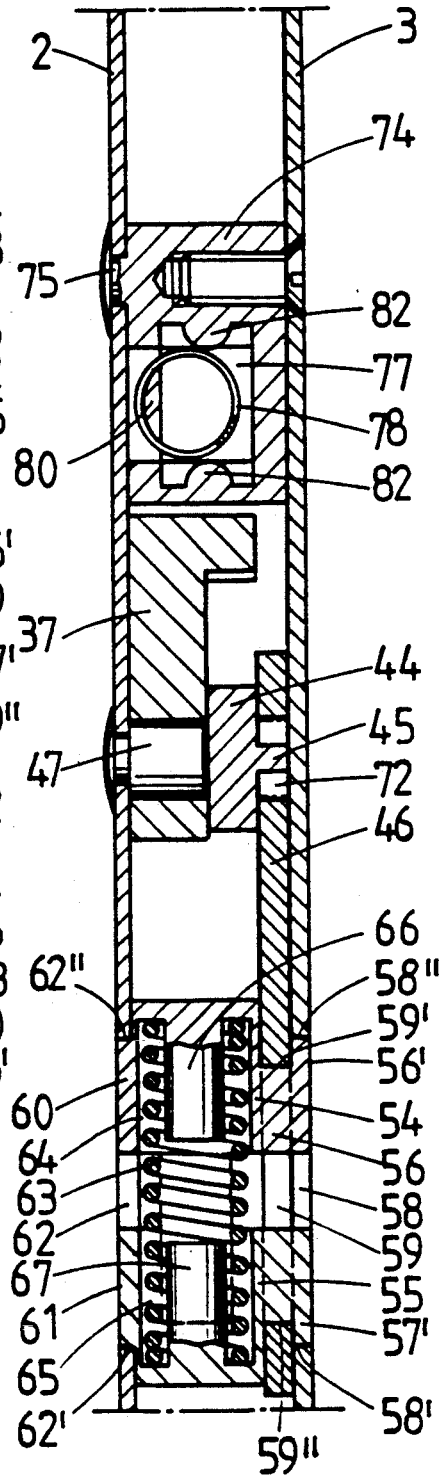
FIG. 4 is a section along the line IV—IV of FIG. 3, on a larger scale.

The hub part 36 is held in the aforementioned basic central position via the coupling member 46 which cooperates with carriages 54, 55 which are spread apart by a compression spring 63. The two of them are held by hook-shaped engagement on the coupling member 46, which is developed in one piece. For this purpose, the coupling member 46, which extends in the direct vicinity parallel to the rear wall in the longitudinal direction of the lock housing, forms a slot 59 into which hooks 56, 57 formed on the carriages 54, 55 engage and thus in part grip over the coupling member 46. The one housing wall—lock cover 3—forms, in this connection, a slot 58 into which the hook heads 56', 57' extend; see, in particular, FIG. 4. Furthermore, the carriages 54, 55, on their sides opposite the hooks 56, 57, bear guide projections 60, 61 for entrance into a slot 62 in the lock bottom 2. The carriages 54, 55 are spread apart by the compression spring 63. Holes 64, 65 extending on the facing end edges of the carriages 54, 55 serve to receive them, centering pins 66, 67 extending into said holes. In this way, the carriages 54, 55 substantially surround the compression spring 63. Furthermore, a substantially rectangular cross section of the carriages 54, 55 is provided. Each carriage forms a tongue 68, 69 which engages into a guide groove 70 and 71 respectively of, in each case, the other carriage. The outer surface of the tongue 68, 69 is aligned in this connection with the corresponding side wall of the carriage. In the case of carriages 54, 55 suspended in the coupling member 46, the hooks 56, 57, as well as the guide projections 60, 61, fit readily into the corresponding slots 58, 62 of lock cover 3 and lock bottom 2. A structural unit consisting of the carriages 54, 55, compression spring 63 and coupling member 46 can therefore easily be installed into the lock without compressing the compression spring 63. At its upper end, the coupling member 46 is provided with an edge-side opening 72 into which the projection 45 of the actuating arm 44 of the hub part 36 extends.

The catch 43 which is guided above the bipartite hub 35 is formed of a catch head 43' and the catch tail 43" which is stepped down with respect to it. On the one side, the catch head of the catch 43 is guided in an opening of adapted shape in the lock front 1 and on the other side its lock tail 43" is guided in a shoe 74. The latter is of block shape and is provided, on its wide surface facing the lock bottom 2, with two protruding insertion pins 75, 76 for entrance into holes of adapted cross section in the corresponding lock wall and lock bottom 2. The insertion pins 75, 76 can possibly be riveted. In this way, the shoe 74 is held fixed against rotation in the lock housing. The thickness of the shoe 74 corresponds to the inside spacing between lock bottom 2 and lock cover 3. Within a recess 77 of the shoe 74 which faces the catch 73, there is a catch spring 78 which acts on the catch tail 43". This spring is developed as a compression spring and rests at one end against a rear wall 79 of the shoe 74 and at the other end against the rear end surface of the catch tail 43"; see, in particular, FIG. 6. A web 80 which flanks the recess 77 serves to secure the catch spring 78 in position. The web ends at a distance from the rear wall 79 and permits the threading on of the catch spring 78.

There is a form-locked guidance between catch tail 43" and shoe 74. The catch tail is developed in flat form with guide grooves 81 present on the narrow surfaces for the entrance of guide ribs 82 of adapted cross section of the shoe 74. In its end region, the catch tail 43" has a threaded hole 83 extending between the guide grooves 81 for the entrance of a screw bolt 84. The head of the latter extends into a slot 85 in the lock cover 3, which slot extends in the direction of movement of the catch 43. The edges of the slot form end stops upon the movement of the catch 43.

The screw 84 furthermore represents the actuating projection for displacement of the catch 43 by hub actuation. The pulling back of the catch 43 is effected via a catch lever 86. The latter is mounted below the hub 35 around a stud 87 provided on the housing side. A hook 88 of the catch lever 86 engages behind the driver arm 42 of the hub part 36. The free end 89 of the catch lever 86 then comes in front of the actuating projection or screw 84. A spring-loaded securing slide 90 is furthermore guided in the direction of displacement of the catch within the shoe 74. The slide is formed of a thickened head 91 and two spring legs 92 adjoining it which rest in the end region of a T-shaped recess 93 in the shoe 74 and urge the head 91 in forward direction in such a manner that the head surface protrudes beyond the corresponding side wall 94 of the shoe 74; see FIG. 6. In the open position of the drive bars 52, 53 the head 91 of the securing slide 90 lies in front of a shoulder 95 of a projection 96 of the drive-bar connecting slide 14. Pins 97 developed on the drive-bar connecting slide 14 serve for its parallel guidance to the lock front 1, said pins engaging in slots 98 in the lock bottom 2. The shoulder 95 extends obliquely upward to the direction of displacement of the securing slide 90 and is arranged opposite an outward control bevel 99 of the projection 96. The head 91 also has control bevels 100, 101 on its end.

Figure 9:
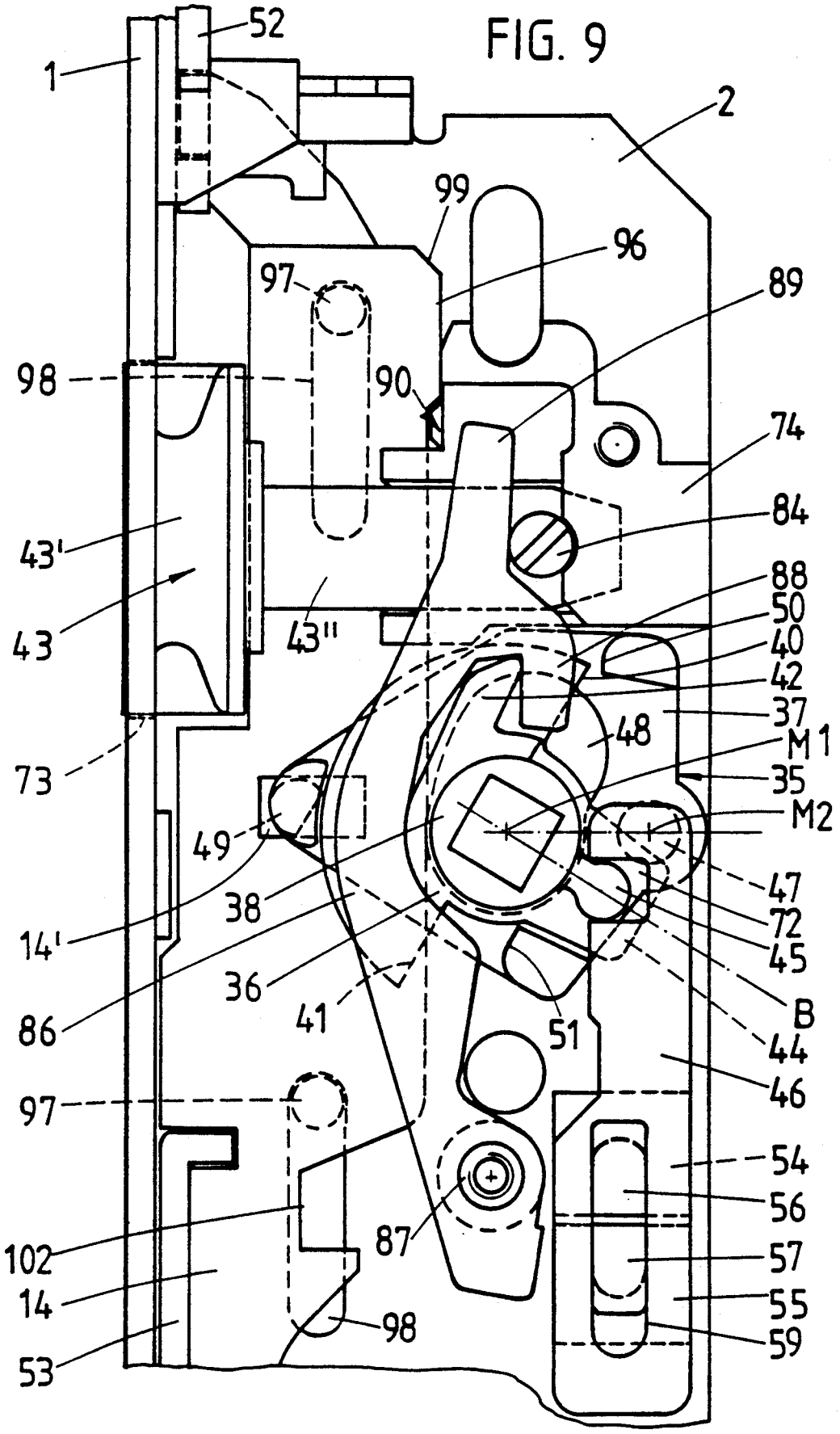
FIG. 9 is a view in accordance with FIG. 5 in which, differing from the latter, the hub part which receives the pusher mandrel is swung by displacement of the pusher in the normal actuating direction, with simultaneous carrying along of the coupling member.

The manner of operation is as follows:

If exclusively the catch is to be withdrawn by means of pusher actuation, this pusher is displaced in the normal pusher actuating direction, namely into the position shown in FIG. 9. Hand-in-hand with a swinging of the pusher into the position B, the hub part 36 alone is displaced around the axis of rotation Ml. Its driver arm 42 acts on the hook 88 of the catch lever 86 and swings the latter in clockwise direction, the end 89 thereof acting on the screw 84—actuating projection—pulling the catch 83 in lock inward direction. The hub part 37 is not carried along in this connection since there is a free passage between the two stop surfaces 40 and 50. Due to the turning displacement of the hub part 36, the projection 45 carries the coupling member 46 along; see also FIG. 10 in this connection. Hand-in-hand with this, the upper carriage 54 is moved in the direction of the other carriage 55 by the upper slot edge 59' of the coupling member 46, compressing the compression spring 63. The lower carriage 55 rests in this connection on the lower slot transverse edges 62' and 58' by means of its guide projections 61 and hook head 57' respectively. If the pusher is released, the compression spring 63 moves the carriage 55 and thus the coupling member 46 back into the basic position shown in FIGS. 4 and 5 together with a turning of the hub part 36 back into the basic central position.

Figure 5:
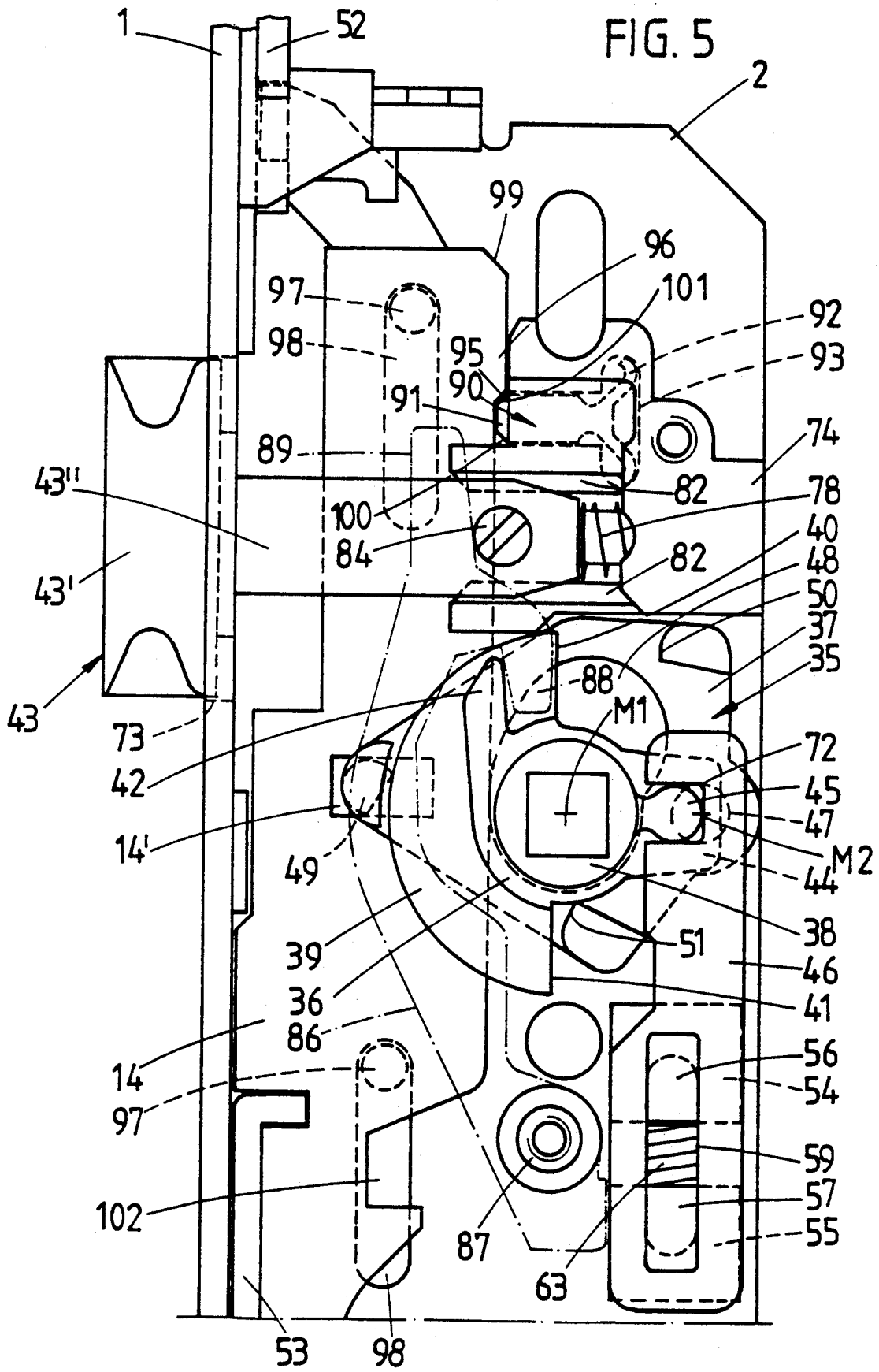
FIG. 5 is a view on a larger scale of the drive-bar lock in the region of the hub and of the catch, in the open position of the drive-bar lock.

In this basic central position, which can be noted in particular from FIG. 5, the security slide 90 which has come in front of the projection 96 of the drive-bar connecting slide 14 prevents a downward displacement of the drive-bar connecting slide 14 and thus of the drive bars 52, 53, so that the latter cannot pass undesired into an interlocked position, caused, for instance, by vibrations.

Figure 11:
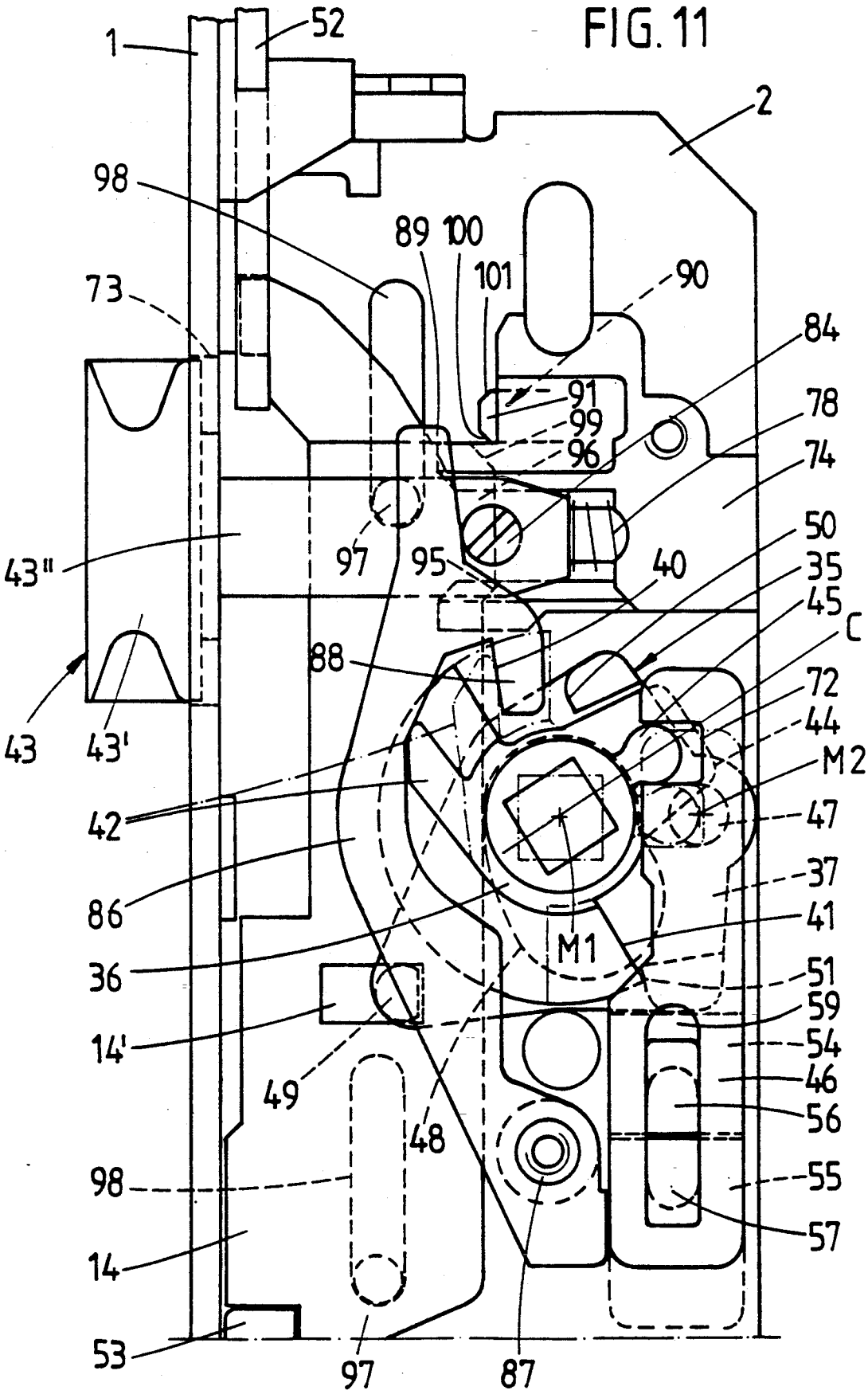
FIG. 11 is another view corresponding to FIG. 5 in which, differing from the latter, the pusher is swung in the opposite direction, displacing the drive-bar connection slide together with the drive bars into the locking position and the coupling member correspondingly carried along.

If the interlocking of the drive-bar lock is to be brought about, then, starting from the basic center position shown in FIG. 5, the pusher is to be displaced in the opposite direction, i.e. in counterclockwise direction, in which case an alignment in accordance with line C is present; see FIG. 11. Hand-in-hand with this, the hub part 36 is turned via the pusher. As a result of the free passage to the catch lever 86 its drive arm 42 does not lead to the carrying along of the catch lever 86. Only the stop surface 41 of the hub part 36 comes against the stop surface 51 of the hub part 37 and swings the latter around its axis of rotation M2, together with a swinging of the hub part 37 in counterclockwise direction. In this process, the drive-bar connecting slide 14 is moved in downward direction and therefore into interlocked position by the driver projection 49 on the hub part 37. Simultaneously with the turning of the hub part 36, the coupling member 46 is carried along in upward direction via the actuating arm 44. During the upward displacement, the lower slot transverse edge 59" of the coupling element 46 carries the lower carriage 54 along in upward direction against the pressure of the compression spring 63. The upper carriage 54, on the other hand, rests via its guide projection 60 and its hook head 56' against the slot transverse edges 62" and 58" respectively; see, in particular, FIG. 12. After release of the pusher, the upper carriage 54 moves back into its starting position carrying along the coupling member 46 which turns the hub part 36 back into the dashed position shown in FIG. 11. The hub part 37 is not displaced in this connection. The locked position can be secured by means of the bolt 9. Upon the closing actuation of the profiled cylinder, the closure member 6' extends into the closure engagement opening 30 of the step-up lever 27. Hand-in-hand with this, the edge 19' of the lever 19 is acted upon, and the latter is swung in counterclockwise direction against the force of the lever spring 17. The blocking extension 26 moves away from the abutment 24 so that, upon a swinging of the step-up lever 27 by means of the closure member 6' via the pin/slot engagement 31, 32, the bolt 9 can be advanced. In advanced position, the rear edge of the lever 19 then lies in front of the abutment 25, which also has traveled through the channel 23 of the lever 19 during the forward closing. Return pressing forces acting on the bolt 9 are therefore conducted over the lever 19 into the abutment 25 and not into the step-up lever 27. In the advanced position of the bolt 9, the stop projection 13 on the bolt 9 has come into a rear recess 102 in the drive bar connecting slide 14 and blocks the displacement thereof.

The path of movement of the closure engagement opening 30 extends in this connection approximately over a quarter-circle V of the cylindrical head section 7 of the profiled-cylinder insertion opening 4. The end mouth point 30' of the edge mounting 33 has shifted, as seen in FIGS. 13 and 16, during the forward closure from the one end point P1 to the other end point P2 of the quarter-circle V. The end points P1, P2 of the quarter-circle coincide approximately alternately with the positions which the end mouth points 30', 30" assume in both closed positions. Therefore, the step-up lever 37 is always reliably carried along during the forward closing as well as during the rearward closing.

Figure 3:
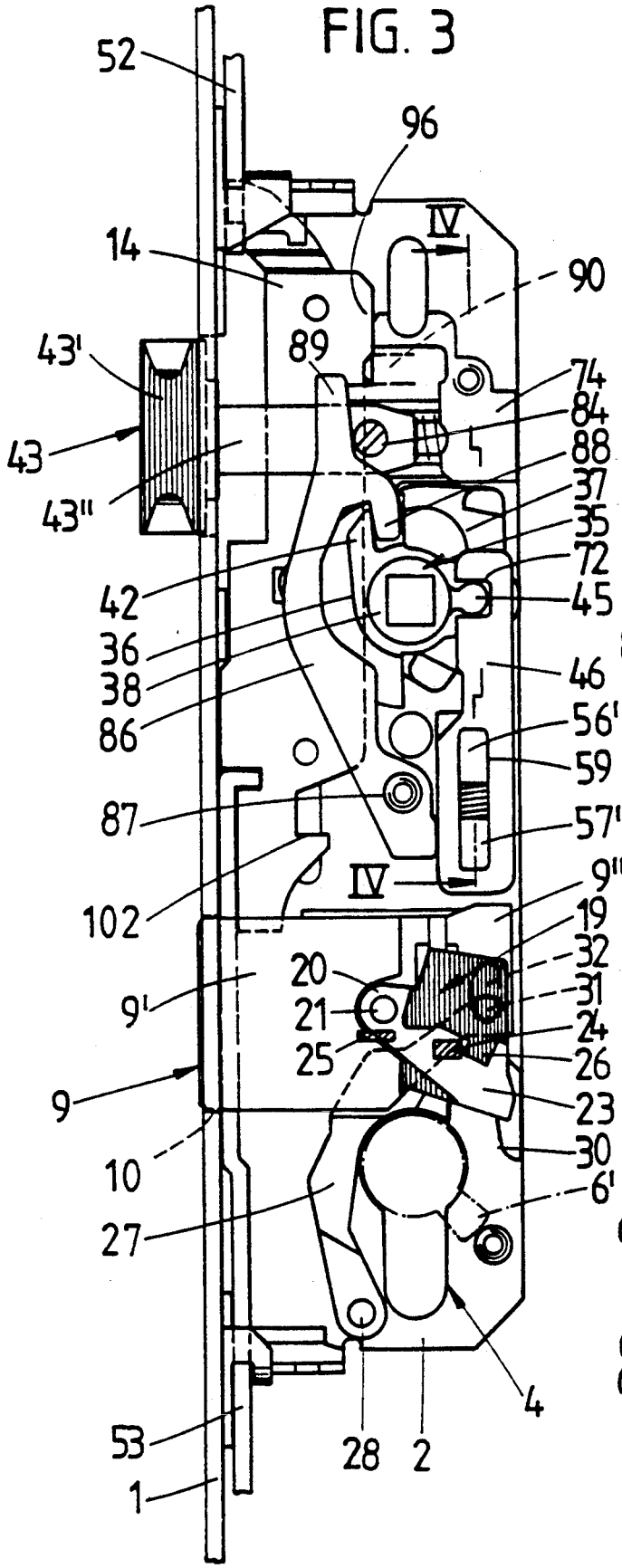
FIG. 3 is a view of the drive-bar lock with the lock cover removed, also for the open position of the drive-bar lock.

The unlocking of the drive-bar lock requires, first of all, the pulling back of the bolt 9 into the starting position shown in FIGS. 3 and 13. Upon the pulling back then of the catch 43, the hub part 37 is at the same time carried along via the hub part 36 over the stop surfaces 40, 50, with simultaneous driving of the drive-bar connection slide 14 into the starting position shown in FIG. 5. In this connection, the projection 96 travels over the securing slide 90 and displaces the latter in opposition to its spring load. After reaching the end position of the drive-bar connecting slide 14, the securing slide 90 again comes in front of the projection 96 thereof. The basic center position of the hub part 36 is then produced via the coupling part 46 which is moved back over the corresponding carriage.

I claim:

1. In a lock with a bolt and catch and a step-up lever, wherein said step-up lever acts on the bolt, has a closure engagement opening for a closure member and is pivoted below an axis of rotation of the closure member, for forward and backward closing of the bolt by means of the closure member with a lengthening of a closing stroke, and another lever which is liftable against spring action by the closure member, the improvement wherein said lock further has a profiled-cylinder insertion opening having a cylindrical head section defining a circle, and said closure engagement opening undergoes a path of movement upon pivoting said step-up lever via said closure member while moving said bolt from its backward closing to its forward closing, and said path of movement of the closure engagement opening extends approximately over a quarter-circle of said cylindrical head section of said profiled-cylinder insertion opening.

2. A lock according to claim 1, wherein said step-up lever has an edge mounting of the closure engagement opening, said edge mounting defines end mouth parts, said quarter-circle defines end points, and said end points of the quarter-circle alternately coincide approximately with positions which said end mouth points assume in both positions of the backward and forward closing of the bolt.

3. A lock according to claim 1, wherein said step-up lever is pivoted at a pivot point and engages said bolt at a slot/pin engagement, and said closure engagement opening does not extend beyond a connecting line of said pivot point of the step-up lever and said slot/pin engagement on the bolt in all positions of the bolt.

4. A lock according to claim 1, wherein said step-up lever has an edge mounting of the closure engagement opening, said bolt has a bolt tail provided with a rear cutout, said another lever is mounted on said bolt, and said edge mounting of the closure engagement opening of said step-up lever lies in a region of said rear cutout in said bolt tail which is covered by a part of said another lever.

5. A lock according to claim 3, wherein said profiled-cylinder insertion opening forms a lower rounded flanged section, and the pivot point of the step-up lever lies at a height of said lower rounded flanged section of the profiled-cylinder insertion opening.

6. A lock according to claim 1, wherein said bolt has a bolt tail, said bolt tail forms a slot, a lever spring rests in said slot in said bolt tail and is at least partially covered by said another lever.

7. A lock according to claim 1, further comprising a lock cover, and two abutments for said another lever, said abutments are fixed on said lock cover.

8. A lock according to claim 7, wherein said abutments are spaced apart from each other in a closing direction of said bolt.

9. A lock according to claim 7, wherein said abutments are arranged spaced apart in height from each other such that one of said abutments is adjacent a front of the lock and is higher than the other of said abutments.

10. A lock according to claim 7, further comprising a channel formed in said another lever, said abutments pass through said channel during movement of said another lever.

11. A lock according to claim 10, wherein a bottom of said channel lies at a same height as a corresponding side wall of the bolt.

12. A lock according to claim 10, wherein said another lever has a mounting plate pivoted to said bolt, and a bottom of the channel continues into said mounting plate, said mounting plate is mounted to said bolt.

* * * * *